United States Patent [19]

Tsuji

[11] Patent Number: 4,550,753

[45] Date of Patent: Nov. 5, 1985

[54] WEFT TRANSFER CONTROL SYSTEM IN AN AIR JET LOOM

[75] Inventor: Kanji Tsuji, Kanazawa, Japan

[73] Assignee: Tsudakoma Kogyo Kabushiki Kaisha, Kanazawa, Japan

[21] Appl. No.: 561,465

[22] Filed: Dec. 14, 1983

[30] Foreign Application Priority Data

Dec. 14, 1982 [JP] Japan ..... 57-189496[U]

[51] Int. Cl.[4] ..... D03D 47/30

[52] U.S. Cl. ..... 139/435

[58] Field of Search ..... 139/435

[56] References Cited

U.S. PATENT DOCUMENTS 4,450,876 5/1984 van Mullekom ..... 139/435

*Primary Examiner*—Henry S. Jaudon

*Attorney, Agent, or Firm*—Staas & Halsey

[57] ABSTRACT

A weft transfer control system for an air jet loom having a main nozzle and a plurality of weft supply members. The system includes a detecting circuit for detecting the release of a weft that is transferred from one weft supply member to another weft supply member and for generating a transfer signal. A control box includes dials for presetting plural initial supply pressures for the main nozzle, corresponding to each of the weft supply members. The control box receives the transfer signal and generates a control signal corresponding to the preset initial supply pressure for the corresponding weft supply member. An electromagnetic air pressure valve and a regulator adjust the supply pressure to the main nozzle to correspond to the preset initial supply pressure on the basis of the control signal. A delay circuit delays the operation of the electromagnetic air pressure valve for a predetermined time to delay the adjustment to the preset initial supply pressure, so that the change in the supply pressure coincides with the ejection of the transfer tail of the weft from the main nozzle.

3 Claims, 6 Drawing Figures

WEFT TRANSFER CONTROL SYSTEM IN AN AIR JET LOOM

BACKGROUND OF THE INVENTION

This invention relates to a weft transfer control system for detecting the change in the position of a transfer tail which connects the end of the weft released from one weft supply member to the beginning of the weft released from the other member and, on basis of the detection signal, applying to a main nozzle the predetermined initial supply pressure suitable for the subsequent weft supply member.

In an air jet loom the transfer speed of the weft varies according to the diameter and the position of the weft supply member. Therefore it is necessary to keep the weft inserting speed constant and stabilize the inserting condition by adjusting the pressure supplied to the weft inserting main nozzle with the decrease in the diameter of the weft supply member.

In a factory equipped with many looms, it is difficult to make a manual adjustment of the supply pressure to the main nozzle. In consideration thereof, a control system has been proposed in which the weft inserting speed is detected by pick-off sensors disposed at the opposite side of the weft supply member and, on basis of the detection signal, the supply member and, on basis of the detection signal, the supply pressure to the main nozzle is adjusted by feedback control, as disclosed under Japanese Patent Disclosure Nos. 56-96938 and 56-107046.

In such a feed-back control system, however, immediately after the change of the weft supply members occurs, the control signal is based on the condition when the previous weft supply member was smallest in diameter and the supply pressure to the nozzle is controlled to be at the value for the smallest diameter of the member. Therefore the actual supply pressure fails to be in accord with the pressure required for inserting the weft of the subsequent supply member which is large in diameter, thereby often causing a failure in weft inserting and stopping the loom.

SUMMARY OF THE INVENTION

It is an object of the present invention to provide a weft transfer control system which solves such problems as seen in the feed-back control system. In view of the fact that the air jet loom is generally provided with a plurality of weft supply members and the end of the weft released from one member is connected to the beginning of the weft from the other member, in accordance with the present invention there is provided a weft transfer control system for detecting the change in the position of a transfer tail which is the connection portion between said end and said beginning of the wefts. On the basis of the detection signal a predetermined value suitable for the diameter of the subsequent supply member, for example the initial supply pressure is applied to the main nozzle.

By the weft transfer control system according to the present invention, it is possible to detect the change in the position of the transfer tail and set the initial supply pressure for inserting the weft released from the new weft supply member. Thus it can fundamentally solve the problem in weft inserting, which cannot be avoided in the feed-back control system at the time of changing the weft supply members. Furthermore, when a delay circuit is interposed in the present system, it can cope with the actual change from the old supply member to the new one and guarantee much more accurate weft inserting because the delay circuit can precisely cause a necessary time-lag between the emission of a transfer signal S1, S2, etc. and the output of a control signal CS1, CS2, etc.

DETAILED DESCRIPTION OF THE PREFERRED EMBODIMENTS

Figure 1:
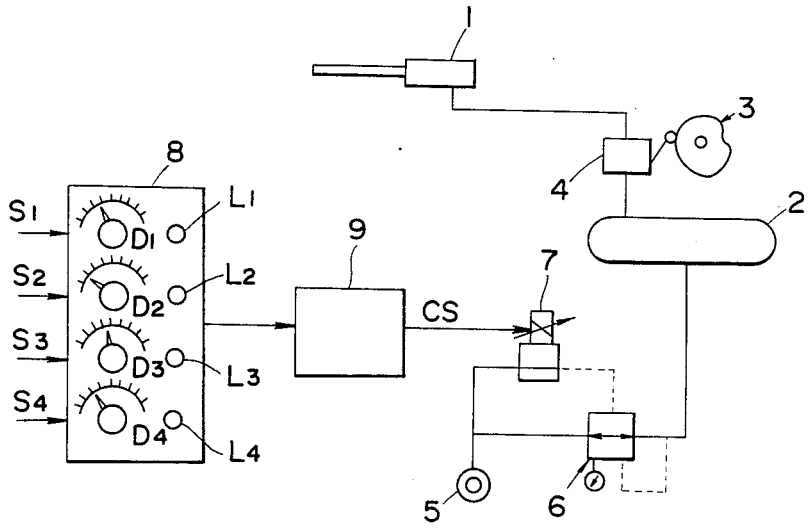
FIG. 1 is a schematic view of an embodiment of the weft transfer control system according to the present invention.

FIG. 1 shows a weft transfer control system for controlling the supply pressure to a nozzle. A main nozzle 1 for use in inserting the weft is supplied with compressed air from a pressurized air tank 2 via an open/close control valve 4 operated by a control cam 3 which rotates synchronously with a crank shaft of the associated loom so that an air jet may rush out of the nozzle intermittently. The supply pressure of the compressed air inside the tank 2 is adjusted by connecting the tank 2 to a pressurized air source 5 via a regulator 6 which is subject to a control pressure from an electromagnetic air pressure valve 7. The electromagnetic air pressure valve 7 is adapted to receive a control signal CS via a drive amplifier 9, so as to apply a predetermined initial supply pressure to the nozzle on the basis of a detection signal (transfer signal) S1 inputted into a control box 8. D1 to D4 are supply pressure setting dials and L1 to L4 are operation indicating lamps.

Figure 2:
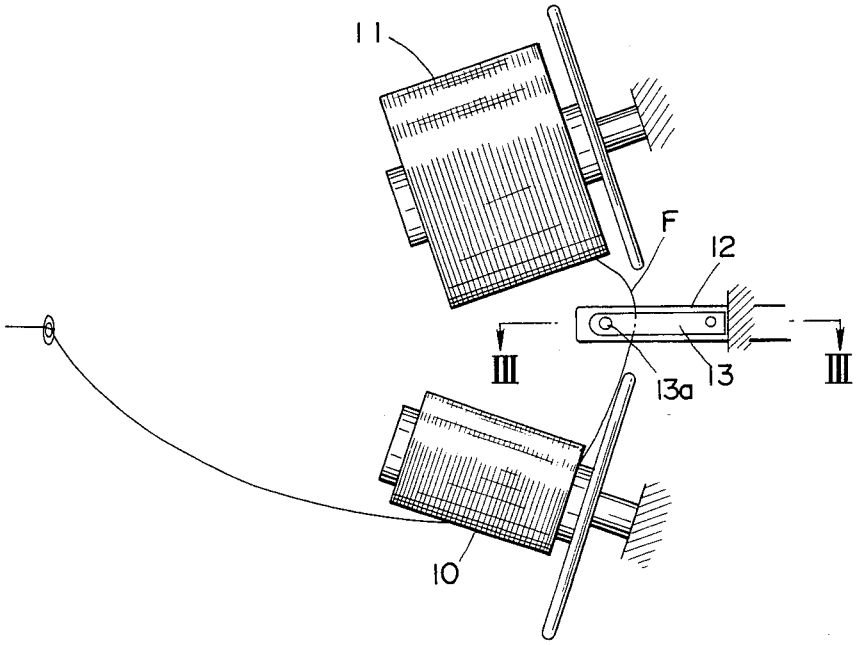
FIG. 2 is a plan view of an arrangement of sensors for detecting the change in the position of a transfer tail.
Figure 3:
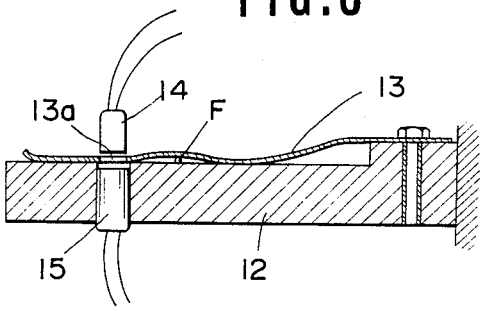
FIG. 3 is an enlarged sectional view taken along the line III—III of FIG. 2.

Therefore, as shown in FIGS. 2 and 3, a bracket 12 is mounted so as to project between adjacent weft supply members 10 and 11, and a plate spring 13 holds a transfer tail F on the top surface of the bracket 12, said transfer tail being a connecting portion between the end of the weft supplied from the member 10 and the beginning of the weft supplied from the other member 11. The plate spring 13 has a perforated hole **13*a* on its tip. A light emitter 14 and a light receiver 15 are disposed above and under the perforated hole 13*a*, respectively. When the transfer tail F passes between the light emitter 14 and the light receiver 15, the detection signal S1 is detected, whereupon the pressure inside the tank 2 is adjusted to the appropriate supply pressure P2 for an initial inserting of the weft released from the subsequent weft supply member 11, and thereafter the properly adjusted pressure is supplied to the main nozzle 1**.

Figure 6:
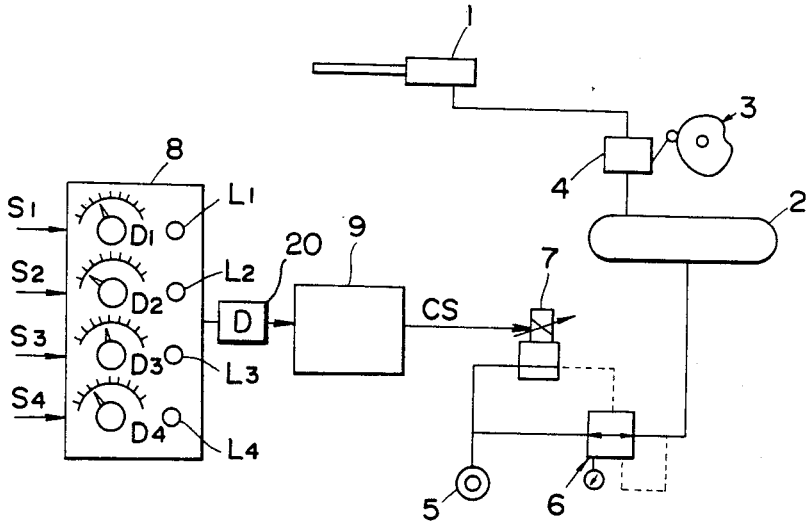
FIG. 6 is a schematic view of an embodiment of the weft transfer control system of the present invention including a delay circuit.

The new weft released from the weft supply member 11 is held in a weft storage device (not shown) before it is flown out of the main nozzle 1 by the air jet thereof. In view thereof, it is actually necessary to somewhat delay the predetermined adjustment of the supply pressure after the transfer signal S1 is emitter. Furthermore in an air jet loom for keeping from one pick to several picks of weft in a storage device and then rushing out the weft pick by pick (e.g., as disclosed under Japanese Patent Disclosure No. 57-29640), the resetting of the supply pressure needs to be delayed for the time period from when the detecting means detects the passing of the transfer tail until when the transfer tail is flown out from the main nozzle. In case of such necessity, a delay circuit may be interposed for causing a necessary time-lag between the emission of the transfer signal S1, S2, etc. and the output of the control signal CS1, CS2, etc. As illustrated in FIG. 6, a delay circuit 20 may be connected between the control box 8 and the drive amplifier 9. Alternatively, the delay circuit 20 may be connected in front of the control box 8 or between the drive amplifier 9 and the electromagnetic air pressure valve 7.

Figure 4:
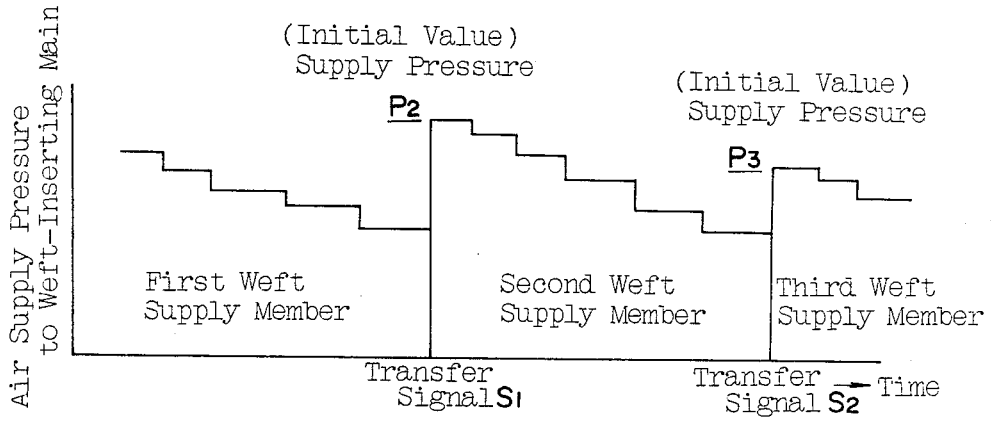
FIG. 4 is a graph of the changes of an air supply pressure set by a control box 8.

The supply pressure to the main nozzle should be determined according to the diameter of the weft supply member and it is set at the predetermined initial value as shown in FIG. 4 by means of the supply pressure setting dial D1 to D4 on the control box 8. The number of the dials corresponds to that of the weft supply members. Thereafter, if it is necessary to decrease the supply pressure with the decrease in the diameter of the weft supply member, i.e. as the member becomes smaller in diameter, the air supply pressure may be decreased in phases as shown in FIG. 4. Although the adjustment can be made both manually and automatically, it is preferable to adopt the aforementioned well-known feed-back control system for detecting the free rush-out speed of the weft and adjusting the air supply pressure.

Figure 5:
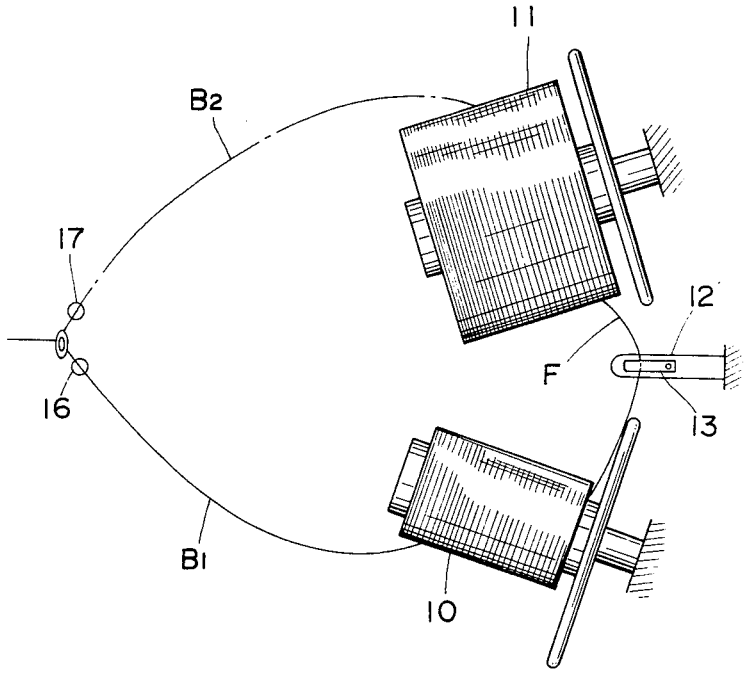
FIG. 5 is a plan view of another arrangement of sensors for detecting the change in the position of the transfer tail.

The change in the position of the transfer tail is detected optically in the above embodiment, but sensors 16 and 17 (FIG. 5) may be used for detecting the change as a change (from B1 to B2) in the position of ballooning of the released weft.

It is to be noted that the present invention is not limited to the above embodiments. Although the change of the air supply pressure to the main nozzle is based on the transfer signal from the weft supply member in said embodiments, other controlling factors of the weft rush-out speed, such as the transfer resistance of the weft arriving at the main nozzle or the supply pressure to a relay nozzle (not shown), may be adjusted.

What is claimed is:

1. A weft transfer control system for an air jet loom having a main nozzle and a plurality of weft supply members, the end of the weft released from one weft supply member being connected to the beginning of the weft released from the adjacent weft supply member, the air jet loom capable of continuously releasing the weft from said weft supply members, said system comprising:

means for detecting that the release of the weft is being transferred from one weft supply member to another adjacent weft supply member and for generating a transfer signal corresponding to the adjacent weft supply member;

a control box, connected to said detecting means, for presetting a plurality of initial supply pressures for the main nozzle, respectively corresponding to the weft supply members, said control box generating a control signal corresponding to the one of the plurality of preset initial supply pressures corresponding to the transfer signal generated by said detecting means;

nozzle pressure adjusting means for adjusting the supply pressure to the main nozzle to the one of the initial supply pressures in dependence upon the control signal generated by said control box; and delay means for delaying the adjusting operation of said nozzle pressure adjusting means for a predetermined time after said detecting means generates the transfer signal.

2. A weft transfer control system as set forth in claim 1, wherein said detecting means comprises a plurality of detector circuits positioned between the weft supply members, each of said detector ciruits comprising:

a bracket positioned adjacent a weft supply member and an adjacent weft supply member;

a plate spring for holding the end of the weft released from the weft supply member;

a light emitter positioned adjacent said plate spring; and a light receiver positioned in the light path of said light emitter, for generating the transfer signal when the end of the weft of the weft supply member crosses the light path of said light emitter.

3. A weft transfer control system as set forth in claim 1, wherein said detecting means comprises sensors, positioned in the release path for each of the weft supply members, for generating the transfer signal when the released weft for the corresponding weft supply member is present in the release path.

* * * * *